US010161394B2

(12) United States Patent
Chaika

(10) Patent No.: US 10,161,394 B2
(45) Date of Patent: Dec. 25, 2018

(54) COUNTERWEIGHTED PUMPJACK WITH REVERSIBLE MOTORS

(71) Applicant: DC INNOVATIONS INC., Edmondton (CA)

(72) Inventor: Darin J. Chaika, Edmonton (CA)

(73) Assignee: DC INNOVATIONS INC., Edmonton (CA)

( * ) Notice: Subject to any disclaimer, the term of this patent is extended or adjusted under 35 U.S.C. 154(b) by 0 days.

(21) Appl. No.: 15/644,758

(22) Filed: Jul. 8, 2017

(65) Prior Publication Data

US 2017/0306945 A1 Oct. 26, 2017

Related U.S. Application Data

(63) Continuation of application No. 14/380,793, filed as application No. PCT/CA2013/000211 on Mar. 8, 2013.

(Continued)

(51) Int. Cl.

| | |
|---|---|
| ***E21B 43/12*** | (2006.01) |
| ***F04B 47/02*** | (2006.01) |
| ***F04B 47/14*** | (2006.01) |

(52) U.S. Cl.

CPC ..... *F04B 47/022* (2013.01); *E21B 43/126* (2013.01); *F04B 47/14* (2013.01)

(58) Field of Classification Search

CPC .... F04B 47/022; E21B 43/127; E21B 43/125; E21B 43/126

See application file for complete search history.

(56) References Cited

U.S. PATENT DOCUMENTS 3,528,305 A * 9/1970 Rizzone ..... E21B 43/127 187/260
3,910,359 A * 10/1975 Childress ..... E21B 3/04 173/165

(Continued)

FOREIGN PATENT DOCUMENTS

EP 0157864 A1 * 10/1985 ..... E02F 9/067

OTHER PUBLICATIONS

"Surface Pumping Units"—Weatherford® brochure (© Weatherford 2014)—excerpt re "Maximizer II".

(Continued)

*Primary Examiner* — David J Bagnell
*Assistant Examiner* — Brandon M Duck
(74) *Attorney, Agent, or Firm* — Donald V. Tomkins

(57) ABSTRACT

A counterweighted well pumping unit comprises two or more reversible motors, each of which is directly and operatively connected to a rotatable drive component mounted on a support structure positioned over a wellhead. For each motor, an elongate, flexible drive element is trained over the associated rotatable drive component, with one end of the flexible drive element connected to a counterweight assembly and the other end connected to a pump rod string associated with the wellhead. Actuation of the motors rotates the rotatable drive components, thus causing the drive elements to move the pump rod string and the counterweight assembly in opposite vertical directions. The rotational direction of the drive motors is alternated so as to alternate the directions of vertical movement of the pump rod string and the counterweight. The counterweight assembly may be concentric with or offset from the wellhead.

20 Claims, 7 Drawing Sheets

Related U.S. Application Data

(60) Provisional application No. 61/608,707, filed on Mar. 9, 2012.

(56) References Cited

U.S. PATENT DOCUMENTS

| | | | | |
|---|---|---|---|---|
| 4,761,120 | A * | 8/1988 | Mayer | E21B 43/127 417/403 |
| 7,001,157 | B2 * | 2/2006 | Xiaoxi | E21B 43/126 166/68.5 |
| 7,673,674 | B2 * | 3/2010 | Lam | E21B 19/12 166/75.11 |

OTHER PUBLICATIONS

"KUDU HSU Hydraulic Stroking Unit"—Schlumberger brochure.
"Rotaflex® Long-Stroke Pumping Unit"—Weatherford® brochure.

* cited by examiner

COUNTERWEIGHTED PUMPJACK WITH REVERSIBLE MOTORS

FIELD OF THE DISCLOSURE

The present disclosure relates to well pumping units for operating rod-actuated downhole oil well pumps and the like.

BACKGROUND

In common methods for producing fluids from a well drilled into a petroleum-bearing subsurface formation, a string of steel production tubing is positioned in the wellbore and extends from the subsurface production zone up to a wellhead at the surface. A downhole pump is disposed within the production tubing in the production zone to raise well fluids (e.g., oil, gas, formation water) to the surface, by reciprocating vertical movement of a travelling valve incorporated into the pump. The travelling valve is reciprocated by a pump rod string (or "sucker rod" string, or simply "pump rod") extending upward within the production tubing to the wellhead where it connects to a "polished rod" extending upward through a wellhead tee and stuffing box to connect to a pumping unit. This type of pump is commonly referred to as a positive-displacement pump or "sucker rod pump".

Various types of well pumping units have been developed for operating positive-displacement downhole pumps, with the most common type being a "pump jack" comprising a walking beam mechanism that reciprocates the sucker rod string connected to the downhole pump, by means of a drive train comprising an electric motor or internal combustion engine, a gear reduction mechanism, and a braking system. The walking beam style of pumping unit is large, heavy, and expensive to build. If the single cable connecting the free end of the walking beam to the polished rod at the upper end of the pump rod string should break, the pump rod string will fall uncontrollably, damaging the well head and possibly losing the entire rod string into the well hole, entailing costly repairs and creating a safety hazard.

It is known to modify a walking beam pump jack to incorporate a counterweight system in order to reduce the total weight that needs to be lifted by the pump jack's drive system. During the upstroke of a downhole pump, the pump jack must lift the total weight of the sucker rod string plus the column of well fluids above the downhole pump's travelling valve. For example, for a rod string that weighs 15,000 pounds (including the travelling valve) and is required to lift a fluid column weighing 10,000 pounds, the pump jack will need to lift a total of 25,000 pounds on each upstroke. At the top of each upstroke, the pump jack's drive system must be disengaged to initiate a downstroke allowing the travelling valve to fall to the bottom of the well. On the downstroke, the 15,000-pound rod string is essentially in a controlled freefall through the liquid in the production tubing. Accordingly, the pump jack apparatus needs to incorporate a robust braking system to regulate the speed of the downstroke.

In a counterweighted pump jack system, the counterweight ideally corresponds to the weight of the rod string plus half the weight of the fluid column to be raised. In the example above, the counterweight would ideally weigh 20,000 pounds (i.e., 15,000 pounds plus ½ of 10,000 pounds), such that the net required lifting force on the pump's upstroke would be only 5,000 pounds. At the top of the upstroke, there would be a net downward force of 5,000 pounds acting on the counterweight—i.e., 20,000 pounds for the counterweight minus 15,000 pounds for the rod string (there being no fluid column load on the downstroke). Therefore, the pump jack's drive system requires a net lifting capacity of only 5,000 pounds—i.e., to lift the rod string and fluid column on the pump's upstroke, and to lift the counterweight on the pump's downstroke. This is in contrast to a non-counterweighted pump jack, which lifts only on the upstroke, but the required lifting capacity is dramatically reduced, as are the braking requirements.

Because a counterweighted pumping unit will typically need to lift on both the upstroke and the downstroke of the downhole pump, the unit's drive system must be reversible. The drive systems of most known pump jacks use conventional electric motors, which rotate in only one direction. Therefore, the use of such motors in counterweighted pumping units requires a reversing mechanism of some type. A suitable control system is provided to alternate the pump stroke direction at the end of each upstroke or downstroke.

One example of a prior art counterweighted pumping unit driven by an electric motor is the Rotaflex® unit manufactured by Weatherford® International Ltd., of Houston, Tex. The Rotaflex® unit has a vertical tower structure and an electric motor at the base of the tower. A gearbox is fitted to the motor's output shaft, and a drive sprocket is mounted to the gearbox. A continuous drive chain is trained around the drive sprocket and around an idler sprocket mounted in an upper region of the tower. A counterweight is connected to a selected link in the drive chain such that the counterweight will move vertically with the drive chain. A mechanical reversing mechanism is provided to alternate the travel direction of the drive chain and in turn the travel direction of the counterweight.

A discontinuous load belt is deployed over an idler roller mounted at the top of the tower, with one end of the load belt being connected to the counterweight and with the other end of the counterweight being connected to the polished rod of a sucker rod string associated with a wellhead. The rotational axis of the idler roller is transverse to the rotational axes of the drive chain sprockets, not parallel. By virtue of the connection of the counterweight to both the drive chain and also to the load belt, actuation of the electric motor causes the load belt to raise either the rod string or the counterweight, depending on the direction of travel of the drive chain (as controlled by the drive system's mechanical reversing mechanism).

The Rotaflex® unit thus provides the benefits of counterweighting in conjunction with a unidirectionally-rotating electric primary drive motor, but has the drawback of requiring complex mechanical apparatus in order to provide the necessary lifting capacity on both the upstroke and downstroke of the downhole pump being actuated by the unit. Particular examples of this mechanical complexity include the need for a gear reducer at the electric drive motor's output shaft (which rotates much faster than the drive sprocket), the specialized mechanical reversing mechanism, and the need for both a drive chain arrangement for reciprocating the counterweight plus a load belt arrangement for transferring lifting force to the rod string during the upstroke of the downhole pump.

U.S. Pat. No. 4,226,404 (Zens) discloses a counterweighted pumping unit that uses a reversible hydraulic motor actuated by a hydraulic pump. The hydraulic motor is directly coupled to a drum so as to rotate the drum about a horizontal axis. A pair of sheaves are provided, one on either side of the drum, with rotational axes generally parallel to the rotational axis of the drum. A first traction cable is fixed at one end to a first selected point on the perimeter of the drum and trained over a first one of the sheaves, with its other end being connected to a counterweight assembly. A second traction cable is fixed at one end to a second selected point on the perimeter of the drum and trained over the second sheave, with its other end being connected to a rod string associated with a wellhead. Rotation of the drum in a first direction will result in the rod string being raised and the counterweight being lowered; rotation of the drum in the opposite direction will result in the counterweight being raised and the rod string being lowered.

The illustrated embodiments of the Zens apparatus include one or more load cables trained over the sheaves, and connected at their opposite ends to the counterweight and to the rod string. The load cables do not engage the drum and therefore are not driven, but they serve to share the counterweight and rod string loads, preferably equally. To prevent uncontrolled lateral migration of the traction cables and load cables during operation of the apparatus, as well as interference between these cables, the perimeter surface of the drum is formed with a continuous helical groove for receiving and training the traction cables, and the perimeter surfaces of the sheaves are formed with parallel annular grooves for receiving and training the load cables.

Due to the helical groove in the drum, the lateral positions of the traction cables at and relative to the drum will shift (in a direction parallel to the drum's rotational axis) as the drum rotatingly oscillates from upstroke to downstroke. Because the lateral positions of the traction cables at the sheaves does not change during operation of the apparatus, the lateral shifting of the traction cables at the drum will cause a fleet angle to develop on each oscillation (i.e., the traction cables, unlike the load cables, will not remain perpendicular to the rotational axes of the drum and sheaves). This generally undesirable condition is overcome in the Zens apparatus by providing an ancillary mechanism for tilting the axis of the drum as necessary to compensate for the fleet angle(s) that would otherwise develop.

The Zens apparatus thus provides an example of a counterweighted pumping unit that avoids the need for gear reduction components and reversing mechanisms as in the Rotaflex® unit. However, it too has disadvantageous mechanical complexities, including the requirement for the large drum associated with the traction cables, the "highly desirable" load cables in addition to the traction cables, and the large sheaves also required for the traction cables and load cables. It is stated in the Zens patent that the size of the sheaves can be reduced by using additional cables; however, providing additional traction cables and load cables introduces additional complexity. A further drawback of the Zens apparatus is the inherent problem of fleet angles developing with respect to the traction cables, which is addressed by introducing further mechanical complexity in the form of a mechanism for constantly tilting the axis of the drum to keep the fleet angle equal to essentially zero.

For the foregoing reasons, there is a need for improved counterweighted pumping units having less mechanically complex drive systems than conventional counterweighted pumping units.

BRIEF SUMMARY

The present disclosure teaches a counterbalanced pump jack comprising a counterweight assembly from which a pump rod string can be suspended. One or more (and typically at least two) reversible drive motors are mounted on an elevated platform. In preferred embodiments, the reversible drive motors are hydraulic motors. For each motor, an elongate, flexible, non-continuous connector (such as, without limitation, a drive belt or drive chain) is trained over a drive sheave (or drive sprocket) that is rotated by the motor. One end of each connector is connected to the counterweight assembly, and the other end is connected to the pump rod string by means of a suitable rod-supporting apparatus (referred to herein a "rod-clamping device", which term is intended to encompass all types of apparatus suitable for connecting to and supporting a pump rod string). The counterweight is of suitable mass to offset a selected percentage of the total weight of the pump rod string and the weight of the fluid column being lifted by the downhole pump.

On the upstroke, the drive motors have to lift only the weight of the pump rod string and the fluid column, minus the weight of the counterweight. At the top of the upstroke, the drive motors reverse direction, initiating a downstroke during which the pump rod string travels downward to its lowermost position. At that point, the drive motors reverse direction, thus initiating the next upstroke.

The use of multiple drive motors working together allow for multiple flexible connectors to be attached to the rod-clamping device. For optimal safety and reliability, the flexible connectors are preferably selected or designed with a safety factor sufficient to ensure that the pump rod string cannot fall even if all but one of the flexible connectors should break.

Accordingly, in one aspect the present disclosure teaches a well pumping unit comprising an elevated platform supported by a support structure, with two or more reversible drive motors mounted on the platform. Each drive motor has a rotating output shaft (alternatively referred to as a drive shaft) operatively connected to a rotatable drive component such that actuation of the drive motor will cause the rotatable drive component to rotate at the same rate as the drive shaft (in other words, a "direct drive" arrangement, with no associated speed reduction means).

For each drive motor, an elongate flexible drive element (which could be, by way of non-limiting example, a drive belt such as a synchronous belt, or a drive chain) is trained over the associated rotatable drive component (which could be, by way of non-limiting example, a synchronous belt pulley or a drive chain sprocket, depending on the type of flexible drive element being used. The flexible drive element is discontinuous, with a first end connected to a counterweight assembly that is vertically movable below the platform, and a second end that is connectable to a pump rod string associated with a wellhead.

Suitable power and control systems are provided to control the operation of the drive motors. In one sense the power system and the control system may be considered as discrete systems. However, since these systems will typically function in direct and substantially constant interaction with each other, in a practical sense they may also be considered as constituting a unified power and control system.

The term "power system" as used in this patent document is referable to one or more components by means of which energy is provided to the reversible drive motors to produce an output torque. In the case of a hydraulic power system, such components would typically include a prime mover (such as, without limitation, a gas engine or an electric motor), a hydraulic pump driven by the prime mover, and a hydraulic fluid reservoir. Locating the hydraulic motors on an elevated platform as disclosed herein allows the prime mover(s), the hydraulic pump(s), the hydraulic fluid reservoir, and/or other related components to be positioned on the ground, with hydraulic fluid lines being routed between the hydraulic pumps and the hydraulic motors, thus minimizing the components that need to be provided on the platform and thereby facilitating efficient power system service and maintenance.

The term "control system" as used in this patent document is referable to a set of components by means of which the pump rod's stroke length, speed, direction of travel (i.e., upstroke or downstroke) are regulated in accordance with selected operational criteria. Persons skilled in the art will appreciate that control systems operationally suitable for use with pumping units in accordance with the present disclosure can be provided in many alternative ways, using well-known technologies, so there are no particular components that necessarily would form part of all such control systems.

In a broad sense, the control system comprises a means or method by which information regarding the state (e.g., speed and direction) of the pump rod string and/or counterweight is received and then synthesized, and it will be the technical nature and characteristics of the selected means or method that will ultimately dictate the particular components required for a particular embodiment of the control system. To provide one non-limiting example, the transfer of information/data regarding the state of the pump rod and/or the counterweight assembly could alternatively be effected through hydraulic, electric, mechanical, pneumatic, or magnetic means.

One aspect of the control system's function is to alternate the rotational directions of the drive motors as required for operation of the well pumping unit, such that on the downstroke of the downhole pump to which the rod string is connected, all of the flexible drive elements will be lifting the counterweight (i.e., all of their first ends will be moving upward), and on the upstroke all of the flexible drive elements will be lifting the rod string (i.e., all of their second ends will be moving upward). Depending on the selected number and arrangement of drive motors, this may entail that one or more of the drive motors at any given time will be rotating in a direction opposite to the rest of the drive motors. For purposes of clarity in the context of this patent specification, the drive motors may be referred to as operating in a "first cooperative sense" when they are all rotating so as to lift the counterweight, and in a "second cooperative sense" when they are all rotating so as to lift the rod string.

In pumping units in accordance with the present disclosure, the flexible drive elements serve as both drive means and load-carrying means, in contrast to prior art counterweighted pump units that use separate flexible drive elements (such as cables, chains, or belts) plus separate flexible load-carrying elements (such as cables, chains, or belts). Drive chains and drive belts of suitable strength and reliability are readily available in various forms. Synchronous belts, which have teeth on one or both sides for meshing engagement with complementary synchronous belt pulleys, are well known (one particularly common use of synchronous belts being for timing belts in automobiles), and can reliably carry large tensile loads, particularly when reinforced with Kevlar® or other reinforcing materials.

In preferred embodiments, the drive motors and their associated rotatable drive components are arranged on the platform such that the flexible drive elements carry substantially equal portions of the weight of the counterweight and the rod string. This arrangement will be advantageous in that all of the drive motors and all of the flexible drive elements will have the same power or load-carrying requirements, with resultant benefits in terms of manufacturing and maintenance costs and efficiencies. However, this is not an essential requirement; for some operational situations, it might be necessary or desirable for the various components of the pumping unit drive system to be arranged such that they carry unequal shares of the lifted loads.

Well pumping units in accordance with the present disclosure may be used on vertical wells, but can also be adapted for use on well that intercept the ground surface at an angle.

In certain embodiments, the counterweight assembly defines a vertical passage through which the second ends of the flexible drive elements can pass for connection to the pump rod string, such that the center of gravity of the counterweight is concentric with the pump rod string. In other embodiments, the counterweight assembly is laterally offset from the pump rod string.

Optionally, the well pumping unit may be provided with a safety cage enclosing at least a portion of the vertical support structure. Other optional safety features include counterweight lockout means and polished rod lockout means, for locking the vertical positions of the counterweight assembly and the rod string in order to protect workers from injury that otherwise might occur due to unintended counterweight and rod string movements during pumping unit maintenance or other activities,

BRIEF SUMMARY OF THE DRAWINGS

Embodiments in accordance with the present disclosure will now be described with reference to the accompanying Figures, in which numerical references denote like parts, and in which.

DETAILED DESCRIPTION

Figure 1:
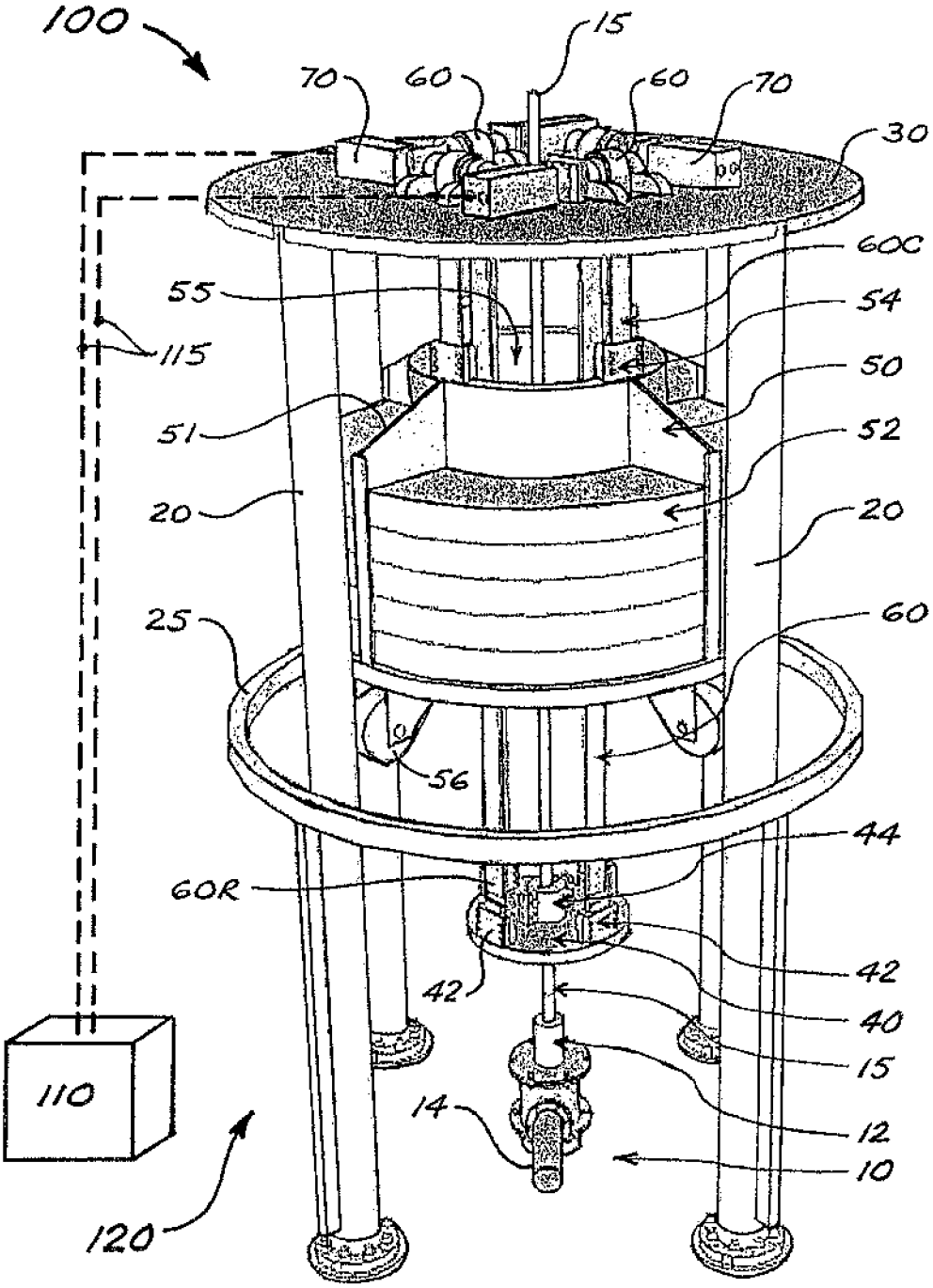
FIG. 1 is an elevational perspective view of a first embodiment of a counterweighted pump jack, shown with the counterweight assembly in a raised position, and with the pump rod string near the bottom of its downstroke.
Figure 2:
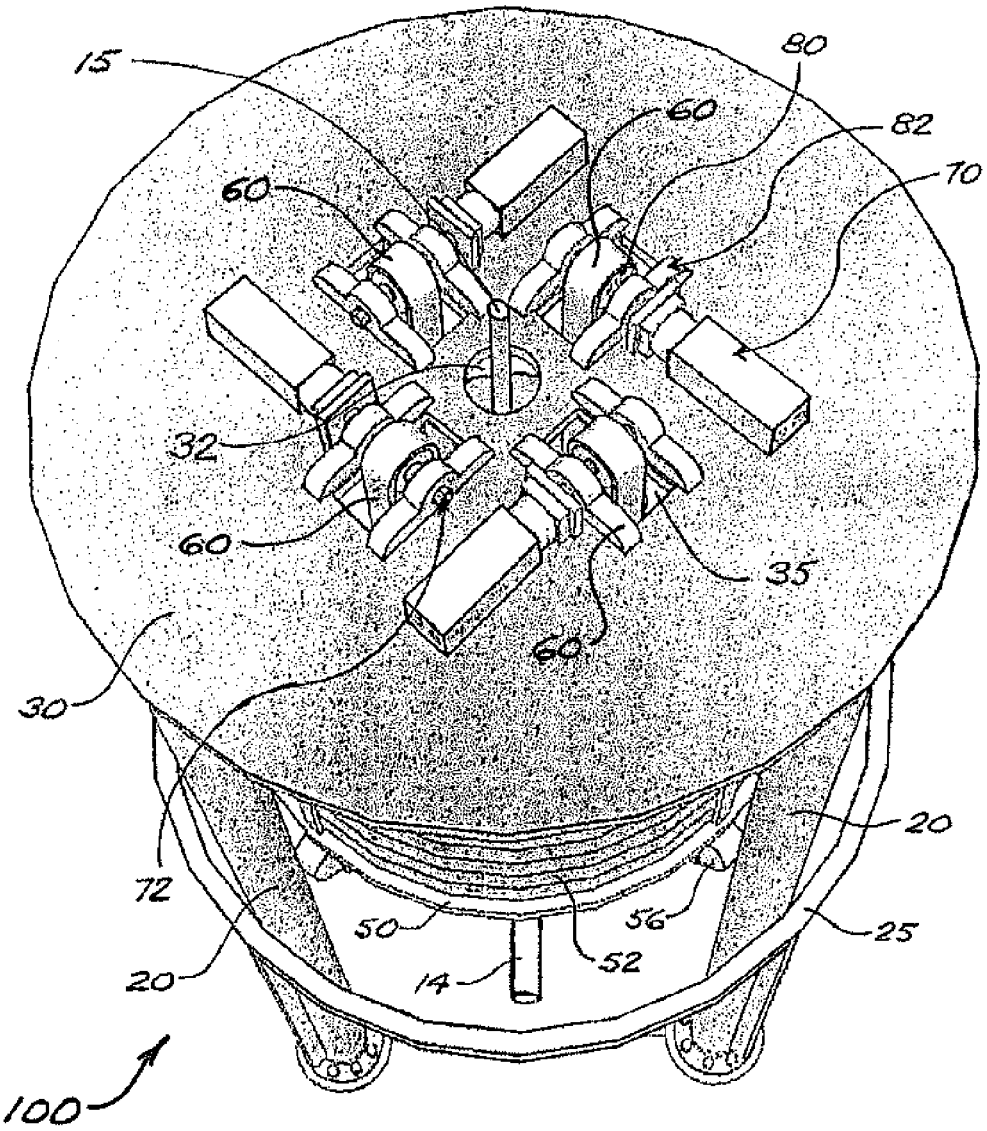
FIG. 2 is a top view of a counterweighted pump jack as in FIG. 1, showing multiple drive motors attached to bearing blocks and drive sheaves via drive shafts.
Figure 3:
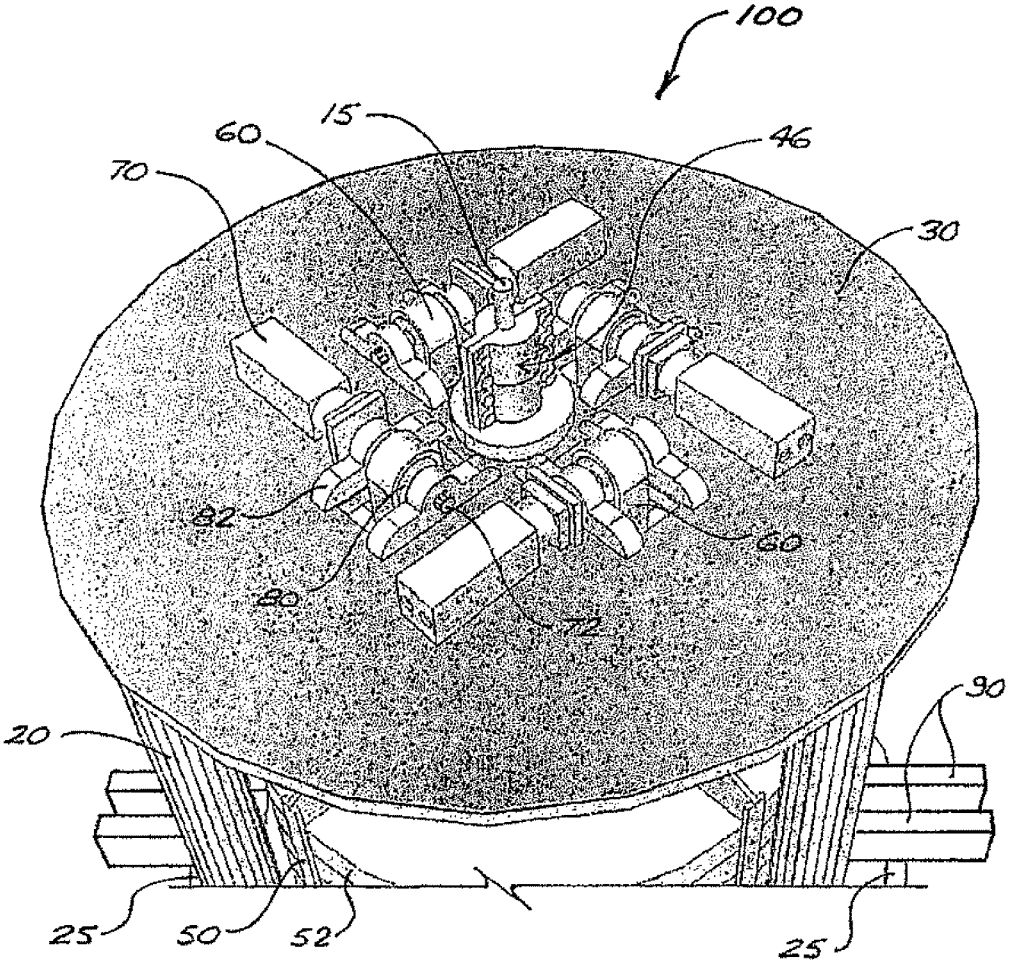
FIG. 3 is an oblique top view of the equipment platform of a counterweighted pump jack as in FIG. 1, shown with exemplary embodiments of counterweight lockout means and rod string lockout means installed.

FIGS. 1-3 illustrate a first embodiment 100 of a well pumping unit in accordance with the present disclosure. Pumping unit 100 comprises a support structure 120 that may be positioned over a wellhead 10 associated with a wellbore. Wellhead 10 will typically include a stuffing box 12 through which and upward from which extends a polished rod 15 associated with a pump rod string connected to a downhole pump (not shown) disposed within a production tubing string installed in the wellbore. Wellhead 10 also includes a flow tee 14 for drawing off fluids produced from the well.

In FIGS. 1-3, support structure 120 is shown as comprising a plurality of vertical columns 20, with a perimeter support member 25 connecting columns 20 at about mid-height. This depiction is solely for conceptual illustrative purposes; the configuration of support structure 120 for a given application will be a matter of design choice, and embodiments of well pumping units in accordance with the present disclosure are not limited to support structures as shown in any illustrated embodiment or to support structures of any other particular configuration.

An equipment platform 30 is provided at the top of or in an upper region of support structure 120. In FIGS. 1-3, platform 30 is shown as a generally solid platform (with openings as needed for functional purposes described later herein), but this is by way of non-limiting example only. In alternative embodiments, platform 30 could have an open-grated surface or could comprise an open structure.

As most clearly shown in FIG. 2, a plurality of drive motors 70, each having an output drive shaft 72, are mounted on platform 30 in a generally symmetrical pattern around a central opening 32 provided in platform 30 for passage of polished rod 15. Each drive shaft 72 operatively engages a rotatable drive component 80 (shown in the Figures in the form of a drive sheave) in association with a pair of suitable bearings 82. Trained in operative engagement over each rotatable drive component 80 is an elongate flexible drive element 60 (shown in the Figures in the form of a drive belt) having a first end 60C and a second end 60R, both of which extend downward on either side of the associated rotatable drive component 80 through a secondary opening or openings 35 in platform 30.

As best seen in FIG. 1, the first ends 60C of all flexible drive elements 60 are connected to a counterweight assembly 50 by means of suitable counterweight connection components 54. In the embodiment shown in FIG. 1, counterweight assembly 50 comprises a cradle structure 51 of generally toroidal configuration with a central vertical opening 55. Cradle 51 is configured to receive removable arcuate counterweight plates 52, and is disposed within support structure 120 so as to be vertically movable therewithin. Also shown is vertical guide means (shown in the form of guide rollers 56 engageable with columns 20) for guiding the vertical movement of counterweight assembly 50 within support structure 120. This illustrated configuration of counterweight assembly 50 is by way of non-limiting example only, and counterweight assembly 50 can be provided in alternative configurations to suit specific operational requirements.

Also as seen in FIG. 1, the second ends 60R of all flexible drive elements 60 are extended downward through central opening 55 in counterweight cradle 51, and are connected to a rod engagement member 40 by means of suitable drive element connection components 42. Rod engagement member 40 engages polished rod 15 by means of a suitable polished rod clamp or clamps 44, such that the distance between the point where second end 60R of each flexible drive element 60 connects to rod engagement member 40 and the point where rod engagement member 40 connects to polished rod 15 is a fixed distance.

It can thus be seen that actuation of all drive motors 70 in a first cooperative sense will cause counterweight assembly 50 to be lifted (while rod engagement member 40 and the associated rod string move downward), and that actuation of all drive motors 70 in a second cooperative sense (opposite to the first cooperative sense) will cause rod engagement member 40 and the associated rod string to be lifted (while counterweight assembly 50 moves downward).

A power and control system (conceptually illustrated in FIG. 1 and indicated by reference number 110) is provided for actuating drive motors 70. Strictly speaking, drive motors 70 form part of power and control system 110, but for purposes of the present discussion, power and control system 110 is considered as comprising means for actuating drive motors 70 and for controlling their operative functions. In preferred embodiments of pumping units in accordance with the present disclosure, drive motors 70 will comprise hydraulic drive motors, and in such embodiments power and control system 110 will comprise one or more prime movers (not shown) actuating one or more hydraulic pumps that circulate hydraulic fluid to and from drive motors 70 by means of suitable hydraulic lines (indicated conceptually in FIG. 1 by reference number 115).

FIG. 3 illustrates pumping unit 100 with the upper end of polished rod 15 extending above platform 30, with suitable polished rod lockout clamps 46 installed as a safety precaution to prevent vertical movement of the pump rod string during service and maintenance operations. For similar purposes, suitable counterweight lockout means (illustrated by way of example as structural beams 90 supported on perimeter support member 25) are shown installed to prevent downward movement of counterweight assembly 50 during service and maintenance operations.

Figure 4:
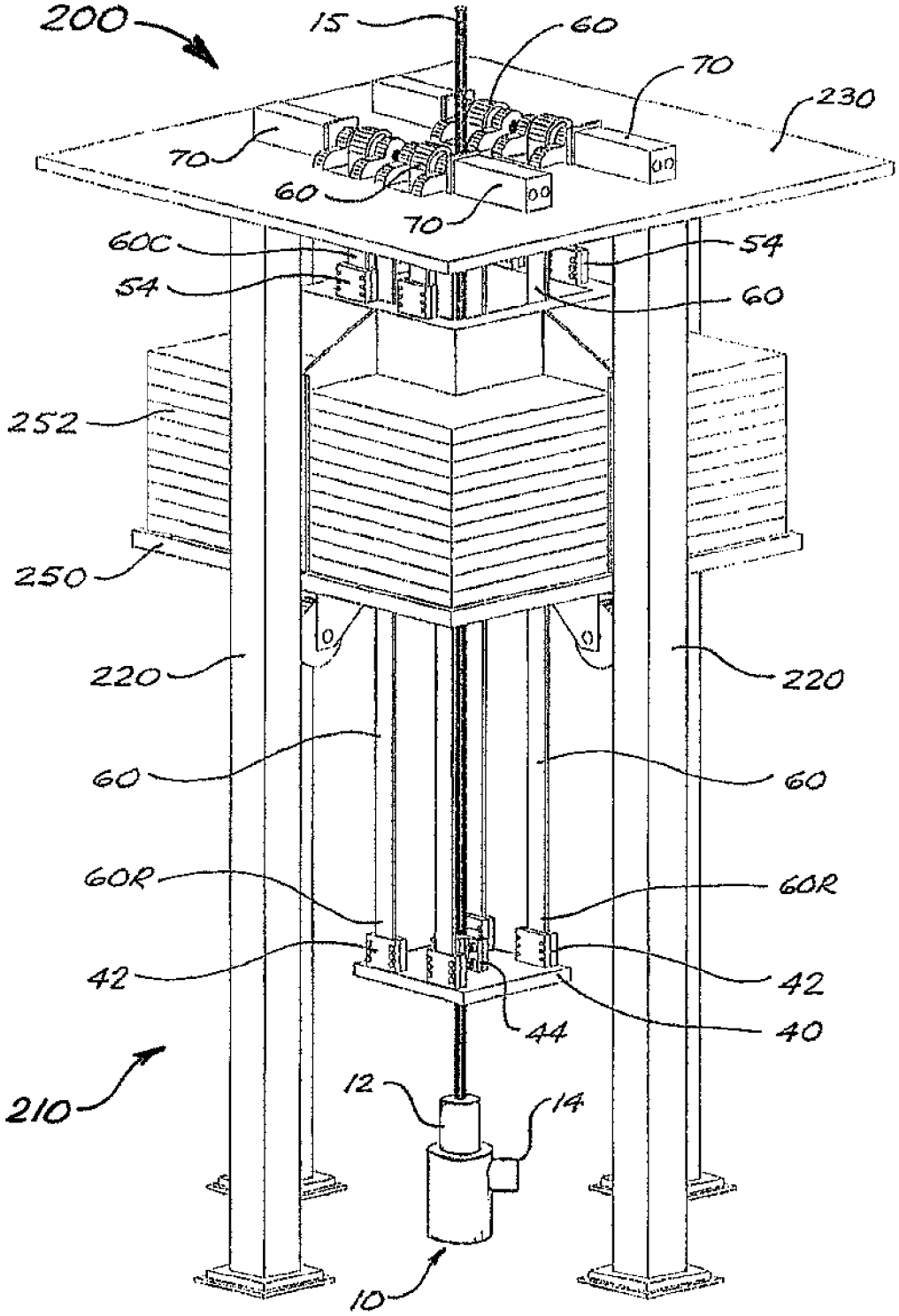
FIG. 4 is a perspective view of a second embodiment of a counterweighted pump jack in accordance with the present disclosure.

FIG. 4 illustrates a second embodiment 200 of a pumping unit in accordance with the present disclosure. Pumping unit 200 differs from pumping unit 100 in FIGS. 1-3 only in that pumping unit 200 is shown with a support structure 210 having square columns 220, a square equipment platform 230, a square counterweight assembly 250 with L-shaped counterweight plates 252, and an alternative layout of drive motors 70. Operationally, pumping unit 200 is essentially the same as pumping unit 100.

Figure 5:
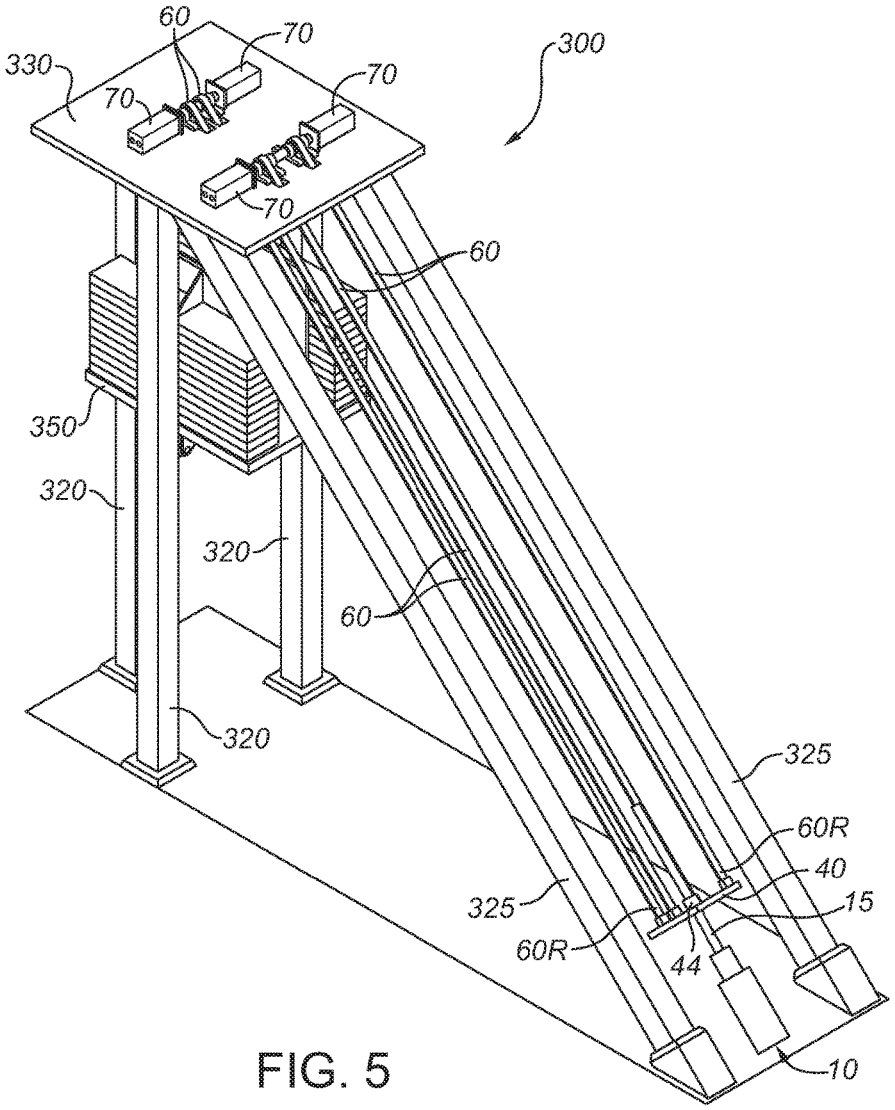
FIG. 5 is a perspective view of a third embodiment of a counterweighted pump jack adapted for operation in association with an angled wellbore.

FIG. 5 illustrates a third embodiment 300 of a pumping unit in accordance with the present disclosure, adapted for use with slanted wells. Pumping unit 300 has vertical columns 320 and inclined columns 325 supporting an equipment platform 330, with drive motors 70 arranged (by way of non-limiting example) similar to the layout in FIG. 4. The counterweight assembly 350 in FIG. 5 is similar to the counterweight assembly 250 shown in FIG. 4, but modified to avoid interference with the sloped portions of flexible drive elements 60 that connect to rod engagement member 40 engaging polished rod 15 projecting from the inclined wellhead 10.

Figure 6:
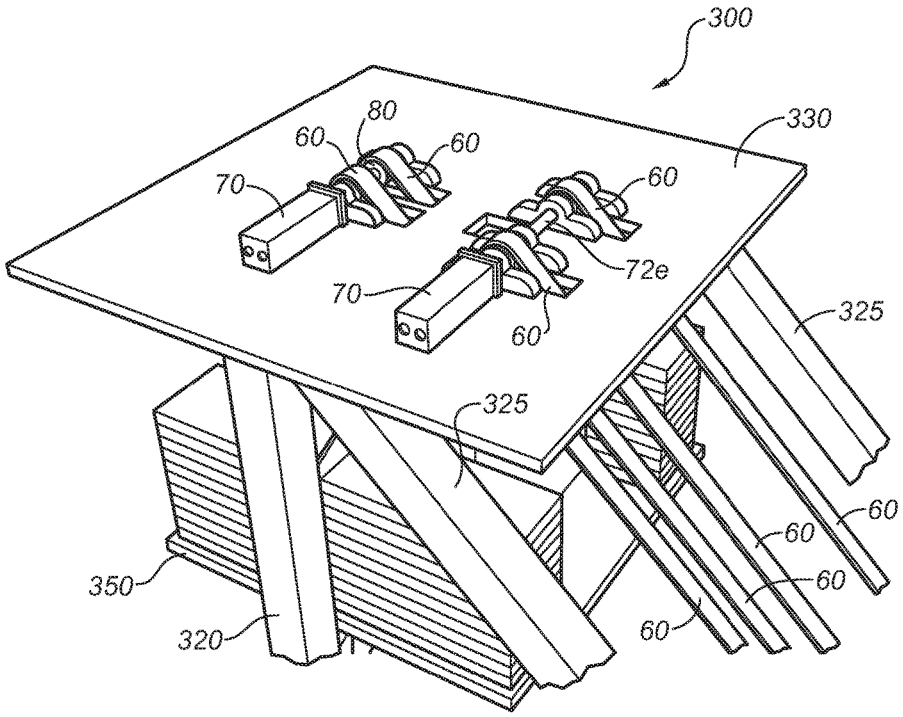
FIG. 6 is a perspective view of a pump jack similar to the pump jack shown in FIG. 5, but with an alternative embodiment of the drive system.

FIG. 6 illustrates an alternative layout for drive motors 70, shown in the context of pumping unit 300 for a slanted well as in FIG. 5. In this layout, there are four flexible drive elements 60 as in the other illustrated embodiments, but only two drive motors 70, each of which has an extended drive shaft 72E to engage two rotatable drive components 80. Although illustrated in association with slant-well pumping unit 300, this and similar drive motor layouts could of course be used with other pumping unit embodiments.

Figure 7:
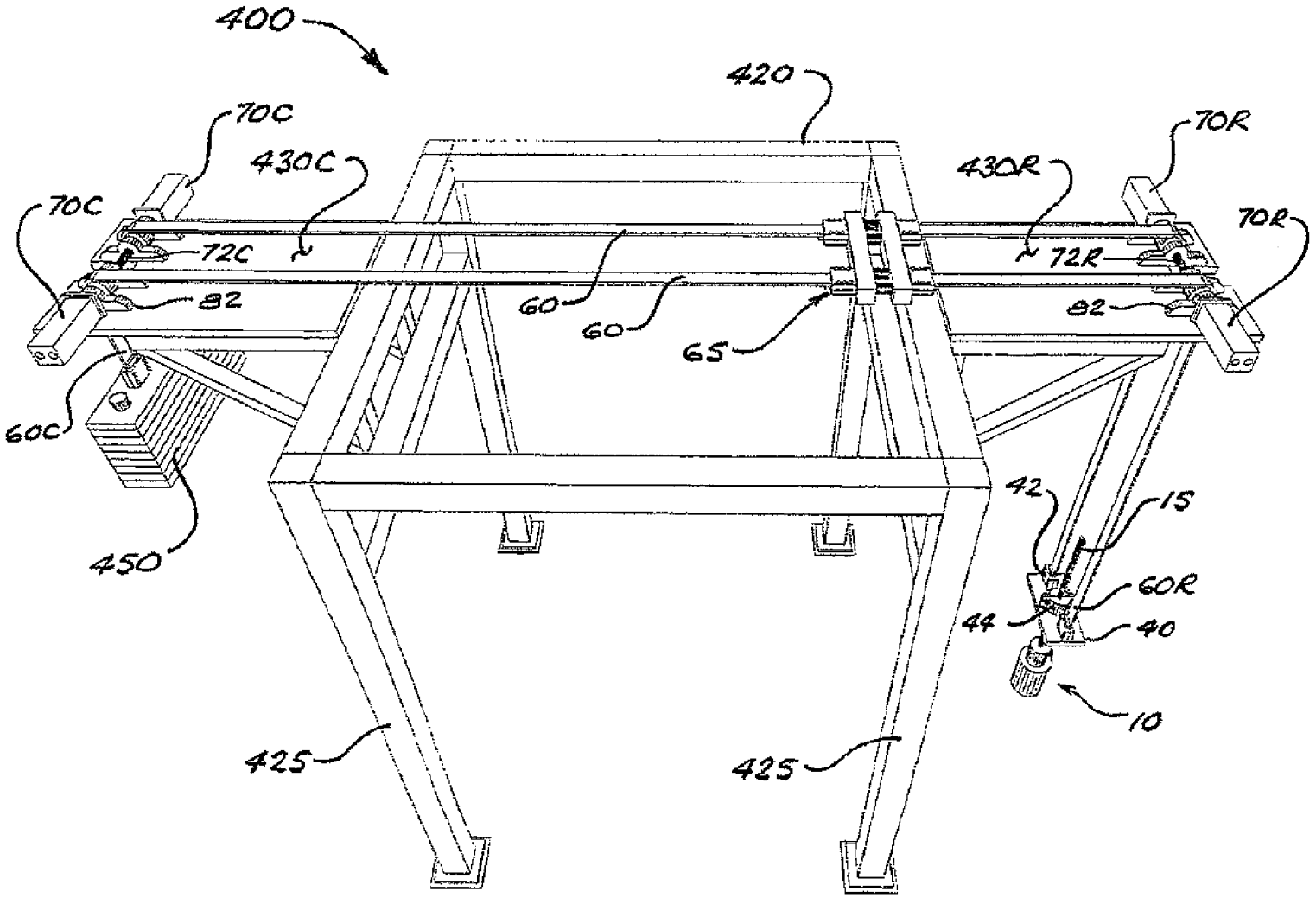
FIG. 7 is a perspective view of a fourth embodiment of a counterweighted pump jack in which the counterweight is laterally offset from the wellbore in association with which the pump jack has been installed, shown with the counterweight assembly in a raised position, and with the rod string near the bottom of its downstroke.

FIG. 7 illustrates a fourth embodiment 400 of a pumping unit in accordance with the present disclosure, having a counterweight assembly 450 that is laterally offset from wellhead 10. Pumping unit 400 has a support structure 420 with columns 425, a first cantilevered platform 430C carrying drive motors 70C associated with counterweight assembly 450, and a second cantilevered platform 430R carrying drive motors 70R associated with polished rod 15. In the illustrated embodiment, intermediate connectors 65 are provided for splicing flexible drive elements 60, but such connectors are optional.

The embodiment shown in FIG. 7 features two drive motors 70C coupled by means of a common drive shaft 72C for jointly rotating a pair of drive sheaves associated with counterweight assembly 450, and two drive motors 70R coupled by means of a common drive shaft 72R for jointly rotating a pair of drive sheaves associated with the rod string. This alternative drive motor arrangement could of course be used with other pumping unit embodiments.

It will be readily appreciated by those skilled in the art that various modifications to embodiments in accordance with the present disclosure may be devised without departing from the scope and teaching of the present teachings, including modifications which may use equivalent structures or materials hereafter conceived or developed. It is to be especially understood that the scope of the claims appended hereto should not be limited by any particular embodiments described and illustrated herein, but should be given the broadest interpretation consistent with the description as a whole. It is also to be understood that the substitution of a variant of a claimed element or feature, without any substantial resultant change in functionality, will not constitute a departure from the scope of the disclosure.

In this patent document, any form of the word "comprise" is intended to be understood in its non-limiting sense to mean that any item following such word is included, but items not specifically mentioned are not excluded. A reference to an element by the indefinite article "a" does not exclude the possibility that more than one such element is present, unless the context clearly requires that there be one and only one such element. Any use of any form of the terms "connect", "engage", "couple", "attach", or any other term describing an interaction between elements is not meant to limit the interaction to direct interaction between the elements in question, but may also extend to indirect interaction between the elements such as through secondary or intermediary structure. Relational terms such as "parallel", "perpendicular", and "concentric" are not intended to denote or require absolute mathematical or geometrical precision. Accordingly, such terms are to be understood as denoting or requiring substantial precision only (e.g., "substantially parallel") unless the context clearly requires otherwise. Wherever used in this document, the terms "typical" and "typically" are to be interpreted in the sense of representative of common usage or practice, and are not to be interpreted as implying essentiality or invariability.

What is claimed is:

1. A well pumping unit comprising:

(a) a platform supported by a support structure;

(b) two or more reversible drive motors mounted on the platform, with each reversible drive motor having a rotating drive shaft operatively connected to an associated rotatable drive component such that actuation of the drive motor will cause the associated rotatable drive component to rotate at the same rate as the drive shaft;

(c) in association with each reversible drive motor, an elongate flexible drive element having a first end and a second end, said flexible drive element being tractively engageable with the associated rotatable drive component, and said flexible drive element being trained over and tractively engaging the associated rotatable drive component such that:

c.1 the first end of the flexible drive element extends below the platform and is connected to a counterweight assembly; and c.2 the second end of the flexible drive element extends below the platform and is adapted for connection to a pump rod string;

such that:

c.3 rotation of all of the two or more reversible drive motors in a first cooperative sense will raise the first ends of all of the flexible drive elements; and c.4 rotation of all of the two or more reversible drive motors in a second cooperative sense opposite to said first cooperative sense will raise the second ends of all of the flexible drive elements; and (d) a power and control system for regulating the operation of the reversible drive motors.

2. A well pumping unit as in claim 1 wherein the second ends of all flexible drive elements are connected to a pump rod string associated with a wellhead.

3. A well pumping unit as in claim 2 wherein the rotatable drive components associated with the two or more reversible drive motors are arranged on the platform such that the elongate flexible drive elements will carry equal percentages of the weight of the counterweight assembly, and will carry equal percentages of the total weight of the pump rod string and loads carried thereby.

4. A well pumping unit as in claim 2 wherein:

(a) the pump rod string extends from the wellhead in a vertical orientation;

(b) the counterweight assembly defines a vertical passage through which the second ends of the flexible drive elements extend for connecting to the pump rod string; and (c) the center of gravity of the counterweight is concentric with the pump rod string.

5. A well pumping unit as in claim 2 wherein the pump rod string extends from the wellhead in a non-vertical orientation.

6. A well pumping unit as in claim 2 wherein:

(a) the pump rod string extends from the wellhead in a vertical orientation; and (b) the counterweight assembly is laterally offset from the pump rod string.

7. A well pumping unit as in claim 1 wherein at least one of the two or more reversible drive motors is a hydraulic motor.

8. A well pumping unit as in claim 1 wherein one of the rotatable drive components comprises a drive sprocket, and wherein the flexible drive element associated with said drive sprocket comprises a drive chain.

9. A well pumping unit as in claim 1 wherein one of the rotatable drive components comprises a drive sheave, and wherein the flexible drive element associated with said drive sheave comprises a drive belt.

10. A well pumping unit as in claim 9 wherein the drive belt comprises a synchronous belt and the drive sheave comprises a synchronous belt pulley.

11. A well pumping unit as in claim 1, further comprising polish rod lockout means.

12. A well pumping unit as in claim 1, further comprising counterweight lockout means.

13. A well pumping unit comprising:

(a) a platform supported by a support structure;

(b) two or more reversible drive motors mounted on the platform, with each reversible drive motor having a rotating drive shaft coupled to an associated rotatable drive component in a direct drive arrangement, such that actuation of the drive motor will cause the associated rotatable drive component to rotate at the same rate as the drive shaft;

(c) in association with each reversible drive motor, an elongate flexible drive element having a first end and a second end, said flexible drive element being tractively engageable with the associated rotatable drive component, and said flexible drive element being trained over and tractively engaging the associated rotatable drive component such that:

c.1 the first end of each flexible drive element extends below the platform and is connected to a counterweight assembly; and c.2 the second end of each flexible drive element extends below the platform and is connected to a rod engagement member, and the rod engagement member is connected to a pump rod associated with a wellhead, such that the distance between the point where the second end of the flexible drive element connects to the rod engagement member and the point where the rod engagement member connects to the pump rod is a fixed distance;

c.3 rotation of all of the two or more reversible drive motors in a first cooperative sense will raise the first ends of all of the flexible drive elements and in turn will raise the counterweight; and c.4 rotation of all of the two or more reversible drive motors in a second cooperative sense opposite to said first cooperative sense will raise the second ends of all of the flexible drive elements and in turn will raise the pump rod; and (d) a power and control system for regulating the operation of the reversible drive motors.

14. A well pumping unit as in claim 13 wherein the rotatable drive components associated with the two or more reversible drive motors are arranged on the platform such that the flexible drive elements will carry equal percentages of the weight of the counterweight assembly, and will carry equal percentages of the total weight of the pump rod and loads carried thereby.

15. A well pumping unit as in claim 13 wherein:

(a) the pump rod extends from the wellhead in a vertical orientation;

(b) the counterweight assembly defines a vertical passage through which the second ends of the flexible drive elements extend for connection to the pump rod; and (c) the center of gravity of the counterweight is concentric with the pump rod.

16. A well pumping unit as in claim 13 wherein the pump rod extends from the wellhead in a non-vertical orientation.

17. A well pumping unit as in claim 13 wherein:

(a) the pump rod extends from the wellhead in a vertical orientation; and (b) the counterweight assembly is laterally offset from the pump rod.

18. A well pumping unit as in claim 13 wherein at least one of the two or more reversible drive motors is a hydraulic motor.

19. A well pumping unit as in claim 13 wherein one of the rotatable drive components comprises a drive sprocket, and wherein the flexible drive element associated with said drive sprocket comprises a drive chain.

20. A well pumping unit as in claim 13 wherein one of the rotatable drive components comprises a drive sheave, and wherein the flexible drive element associated with said drive sheave comprises a drive belt.

* * * * *